United States Patent [19]

Bayless et al.

[11] Patent Number: 4,662,096

[45] Date of Patent: May 5, 1987

[54] DISPLAY AND STREET SIGN ASSEMBLY HAVING MULTI DISPLAY FACES

[75] Inventors: Gary L. Bayless, Homestead, Fla.; Armando Amaya, 600 Washington Ave., Homestead, Fla. 33030

[73] Assignees: Armando Amaya; Vertner H. Harben, III, both of Homestead, Fla.

[21] Appl. No.: 765,769

[22] Filed: Aug. 15, 1985

Related U.S. Application Data

[63] Continuation of Ser. No. 623,781, Jun. 22, 1984, abandoned.

[51] Int. Cl.[4] ..... G09F 15/00

[52] U.S. Cl. ..... 40/607

[58] Field of Search ..... 40/606, 607, 479, 612; 248/551, 519, 518.4, 519.1

[56] References Cited

U.S. PATENT DOCUMENTS

| | | | |
|---|---|---|---|
| 2,710,472 | 6/1955 | Leander | 40/607 |
| 3,218,746 | 7/1963 | Hawkins, Jr. | 40/607 |
| 3,579,880 | 5/1971 | Murphy | 40/607 |
| 4,262,439 | 4/1981 | Dinan et al. | 40/607 |
| 4,347,678 | 9/1982 | Laasko | 40/607 |
| 4,353,179 | 10/1982 | Jennings | 40/607 |

*Primary Examiner*—Robert Peshock
*Assistant Examiner*—Cary E. Stone
*Attorney, Agent, or Firm*—John Cyril Malloy

[57] ABSTRACT

A display sign having a plurality of display faces removably supported on the upper end of an elongated standard wherein the lower end thereof is secured to a base which is at least partially burried beneath a supporting ground surface such that the sign assembly is maintained in an upright orientation. The standard is of a predetermined length such that the display faces are spaced above the supporting ground surface at least a minimum distance and further where each of the display faces are separated into a first display zone adapted to have printed media such as street names thereon and a second display zone adapted to have printed and pictorial advertising media displayed thereon.

10 Claims, 5 Drawing Figures

DISPLAY AND STREET SIGN ASSEMBLY HAVING MULTI DISPLAY FACES

This is a continuation of application Ser. No. 623,781 filed June 22, 1984, now abandoned.

BACKGROUND OF THE INVENTION

1. Field of the Invention

This invention relates to a street sign having multi-display faces positioned in an upstanding above ground location wherein each of the display faces include a first display zone for representing street names and like printed media and a second larger zone for including pictorial and printed advertising media in an area segregated from the street name or identification.

2. Description of the Prior Art

Display signs of various structures, designs and configurations are well known in the prior art. More specifically, the prior art has developed to such a point where sign structures are designed for particular applications such as advertising, road signs, traffic information etc. In that the art has advanced to the extent that each sign is particularly intended for a specialized application, there still exists a recognized need for a sign assembly which may accomplish a specific designed function such as serving as a street sign but have other wider applications such as in advertising. The following U.S. Pat. Nos. are representative of existing and prior art devices and include: Lamar, 1,744,647; Taylor, 2,114,943; McColl, 2,652,762; Spooncer, 3,113,552; Pogue, 3,167,874; Iverson, 3,579,885; Attwood, 3,928,930; Dotson, 4,250,491; and Dinan et al, 4,262,439.

While the structures disclosed in the above-noted patents are certainly operable in a particular application for which they were designed, each may be considered to be somewhat limited for a variety of applications. In addition, the structures set forth in the above-noted patents to McColl, Pogue and Iverson include specific structural features which allow them to be dismounted or removed from its supporting standard or like device. However, such dismounting or disconnection entails substantially disassembling the plurality of display signs and/or display means itself. This limits the versatility of such a sign structure especially wherein it is desired to remove a plurality of display faces, as a unit, from a supporting standard.

Further, there is also a recognized need in the industry for a display sign assembly capable of satisfying specific requirements such as serving as a street sign while at the same time having the additional versatility of displaying advertising media on each one of the plurality of display faces in conjunction with the displaying of a street name or like identifying geographical information.

SUMMARY OF THE INVENTION

The present invention is directed towards a display sign assembly having a plurality of faces mounted on a display means wherein each of the faces are disposed in substantially transverse relation to one another and extend outwardly from the display means in a different direction. This allows observation of the signs from almost 360° since, in a preferred embodiment to be described in greater detail hereinafter, the signs preferably are located in perpendicular relation to one another.

An important feature of the present invention is directed towards the individual display faces comprising at least a first display zone specifically adapted and dimensioned to have print media disposed thereon and be representative of the identity of certain geographical locations such as the names of streets. Each display face further includes a second display zone which may have a generally larger exposed surface area than the first zone and which is dimensioned and generally adapted to have pictorial representations as well as printed media mounted thereon and being generally representative of advertising. Therefore, while the plurality of display faces are each specifically designed to serve as street signs and be strategically located such as on the corner of intersecting streets or the like, each of the display faces may concurrently be used to display advertising media. Such advertising representations are therefore readily brought to the attention of those in the general vicinity of the subject sign assembly particularly when looking for the identity of the intersecting streets.

Other structural features of the present invention include the display means comprising a plurality of display faces mounted in supported engagement on the upper end of an elongated standard. The standard has its opposite or lower end secured to a base wherein both the base and the lower end is substantially burried or disposed to extend below a supporting ground surface. The structure of the base itself may comprise a cementitious material anchoring sleeve disposed in encasing and bonded relation to the lower end. The base is of a sufficient length so as to securely anchor the sign assembly within the supporting ground. The remainder of the sign assembly extends in an upright orientation above the surface of the supporting ground. The display means and plurality of display faces are maintained at a predetermined height above the supporting surface.

The overall length of the standard is such as to position the display means at least a minimum predetermined height above the supporting ground surface wherein such height is dependent upon certain local ordinances or requirements directed to the location of street signs or other advertising display signs. Further, it is important to locate the plurality of display faces at least a minimum distance above the supporting ground surface so as to avoid ready access thereto and thereby avoid vandalism, damage and otherwise disfiguring of the display faces. The length of the base and accordingly the length of the lower end of the standard encased by the base generally is dependent upon the soil conditions of the supporting ground, the overall height of the standard and the weight of the combined standard and display means. Preferably, the standard extends upwardly from the supporting ground surface to an under portion of the display means a distance of approximately 7½ feet. Such distance is generally 2½ to 3 times greater than the length of the base means disposed in burried or penetrating relation beneath the supporting ground surface. The length of the burried base means and the distance the standard extends from the ground surface to the display device is of course dependent upon the overall dimension and accordingly the weight, air resistance, and other structural characteristics of the display device itself.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
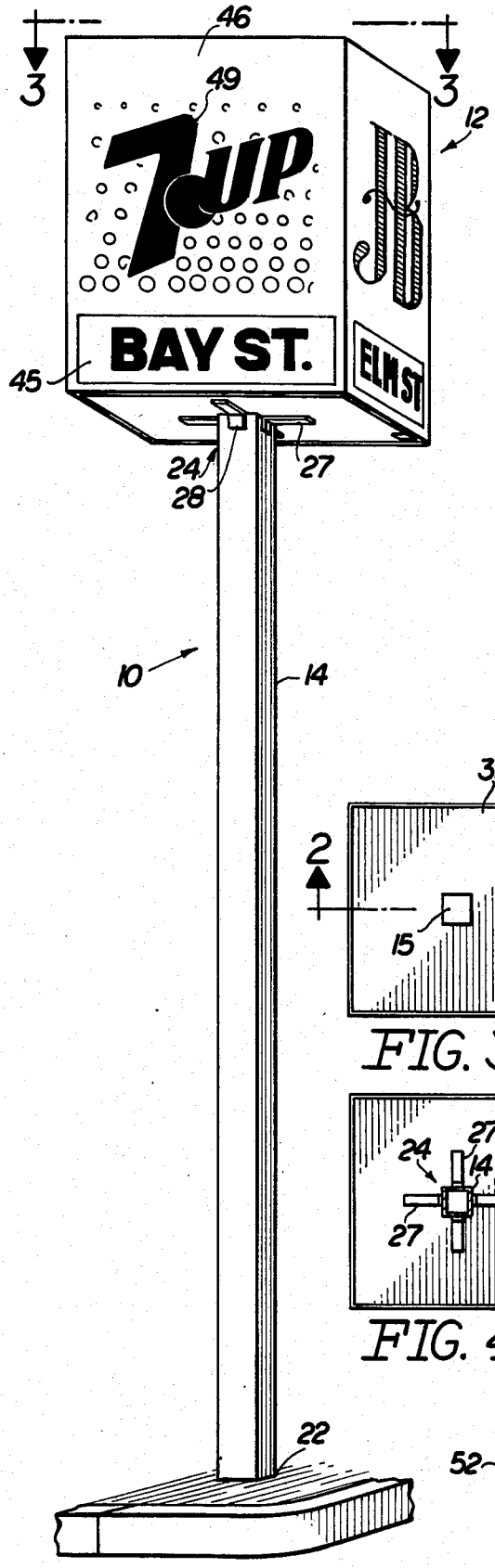
FIG. 1 is a perspective view of the display and street sign assembly of the present invention.
Figure 2:
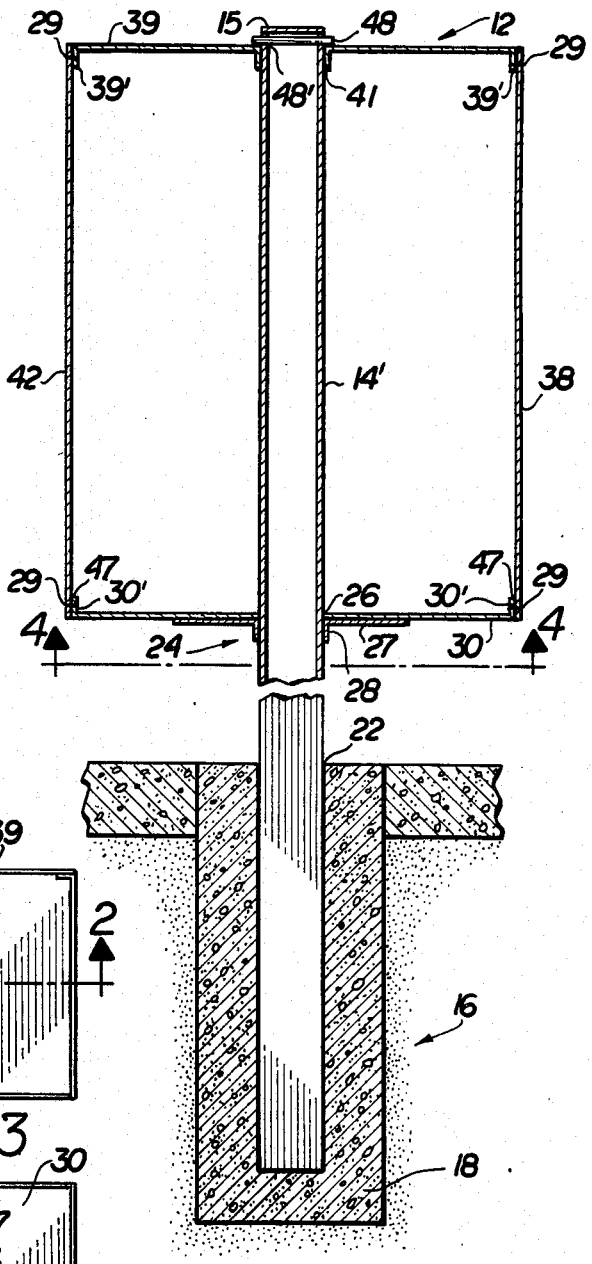
FIG. 2 is a sectional view showing structural details of the various components of the sign assembly.

As best shown in FIGS. 1 and 2, the present invention is directed towards a sign assembly generally indicated as 10 and including a display device 12 supported on the upper end of an elongated supporting standard 14. The lower end as at 16 is secured in encasing relation to a base means which includes an anchoring sleeve 18. The anchoring sleeve is made from cementitious material and is at least partially buried below a ground supporting surface generally indicated as 22. More specifically, the anchoring sleeve 18 encases the lower extremity of the lower end of the standard 14 and extends upwardly therefrom a predetermined minimum distance dependent on the overall dimension of the standard 14 and the dimension and configuration of the display device 12. The specific dimensions of the various components of the sign assembly and their relation to one another will be described in greater detail hereinafter.

Figure 5:
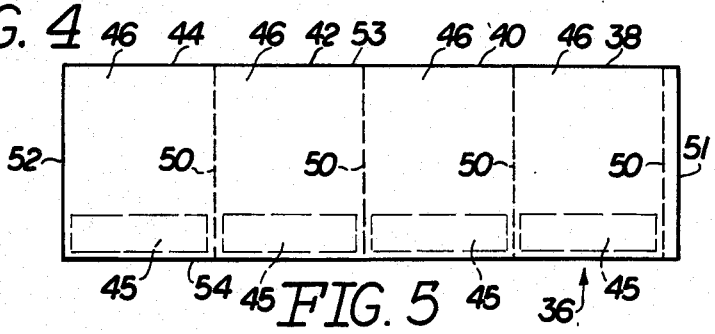
FIG. 5 is a front plan view of a display panel defining a plurality of the display faces integrally thereon and oriented in a planar orientation prior to being folded such that the plurality of display faces are disposed in transverse relation to one another.

With reference to FIGS. 1, 2 and 5, the display device 12 comprises a plurality of display faces 38, 40, 42 and 44 each integrally formed on a display panel 36. The display panel 36 is preferably formed from a baked aluminum material but may be readily formed from any other flexible material capable of being bent or folded along each of the plurality of fold lines 50 disposed in substantially segregating relation to the individual display faces 38, 40, 42 and 44. In the embodiment shown (FIG. 5), fold lines 50 are disposed in substantially parallel relation to one another and to spaced apart, opposite peripheral edges 51 and 52 and in transverse relation to the longitudinal peripheral edges 53 and 54. With reference to FIG. 1, and in the preferred embodiment, it is readily seen that the individual display faces are oriented in substantially transverse relation to the next adjacent face or faces and preferably are arranged in perpendicular relation to such next adjacent faces. By establishing such orientation, the plurality of display faces, 38, 40, 42 and 44 collectively define the lateral peripheral boundaries of the display device 12 and a hollow interior portion therein.

With respect to FIG. 5, an important structural feature of the present invention comprises each of the display faces including a first display zone 45 having an exposed surface which is specifically dimensioned and configured to extend along the lower peripheral edge 54 of each of the display faces and being adapted to have print media displayed thereon. Such print media, as shown, may be representative of street names or like geographical locations and therefore the overall sign assembly 10 may serve as a street sign located at an appropriate junction of streets such as on the corner thereof. Further, each of the display faces 38, 40, 42 and 44 further includes a second display zone 46 wherein the exposed area of the second zone is substantially greater than the exposed area of the first zone 45. The exposed or display surface of the second zone 46 is specifically adapted to have pictorial and/or printed representations 49 formed thereon which may be generally representative of advertising media. Therefore, the sign assembly of the present invention has the advantage of a specific application such as a street sign an also has the versatility of serving to present and display advertising media concurrently with the display of the street location and/or identification.

Figure 3:
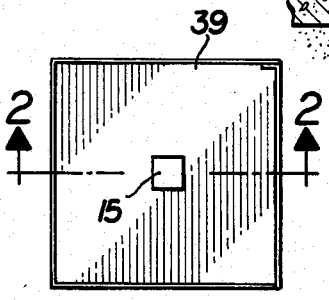
FIG. 3 is a top plan view along line 3—3 of FIG. 2.
Figure 4:
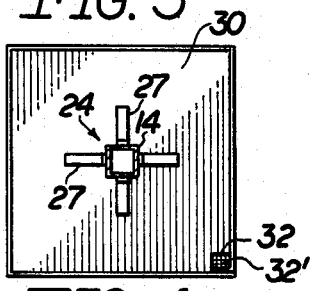
FIG. 4 is a bottom plan view showing additional structural details of a mounting support structure of the present invention and taken along line 4—4 of FIG. 2.

With reference to FIGS. 2, 3 and 4, the display means 12 of the present invention further includes a bottom portion 30 and a top portion 39. In a preferred embodiment, each of the bottom and top portions have a substantially planar configuration and each have an aperture means 26 and 41 respectively formed therein. The respective aperture means 26 and 41 are disposed in linear aligned relation to one another and are specifically disposed, dimensioned and configured to allow passage therethrough of the upper end 14' of the standard 14 (see FIG. 2). The respective aperture means are dimensioned at least slightly greater than the exterior surface of the standard 14', at the upper end thereof, so as to allow sliding movement of the bottom and top portions 30 and 39 respectively relative to the upper end 14' of the standard means. By virtue of this arrangement, the entire display means 12 can be removably mounted on the upper end 14' of the standard 14 and thereby readily be removed therefrom for repair and/or replacement of the advertising media or print media located on the various zones of the individual display faces.

As best shown in FIG. 2, the bottom and top portions 30 and 39 extend generally outwardly from the respective aperture means 26 and 41 and each include a peripheral flange or lip 30' and 39' respectively. These flanges extend outwardly from the respective main base portions or planes of the bottom and top portions and are further disposed for direct connection to each of the plurality of display faces 38, 40, 42 and 44 about the common lower peripheral edge 54 and common upper peripheral edge 53 respectively. Such interconnection between the plurality of faces and the bottom and top portions along the respective flanges 30' and 39' is accomplished by any of a number of conventional connectors and preferably by a plurality of pop rivets 29 extending through both the plurality of faces and the individual flanges 30' and 39'. An additional structural feature of the present invention includes the provision of a caulking or grout material serving as a water sealant 47 and disposed at the junction of the longitudinal peripheral edges 53 and 54 and the respectively positioned and secured flanges 30' and 39'. Such sealing material 47 may in fact be disposed along each of the seams defined at junctions of the interconnected panels and top and bottom portions in order to better seal the interior portion of the display means 12 from external weather conditions including rain, wind, etc. As shown in FIG. 4, a vent aperture 32 and screen element 32' may also be disposed at least partially within the bottom portion 30 and serve to allow venting of any accumulated liquid from the interior of the display means 12 as well as passage of trapped air therefrom if such is desired.

Another important structural feature of the present invention comprises a mounting means which includes a mounting support structure generally indicated as 24 (FIGS. 2 and 4) which is secured to the exterior surface of the standard 14 in spaced relation from an upper extremity 15 thereof. Further, the mounting support structure 24 is configured to extend outwardly from the surface of the standard 14 into interruptive and supporting engagement with the bottom portion 30 as it rests on the mounting structure 24. More specifically and in the preferred embodiment, the mounting structure 24 comprises a plurality of brackets each having a substantially L-shaped configuration wherein one leg 28 is secured as by welding or other means to an outer surface of the standard 14 and wherein the individual brackets are disposed in spaced relation to one another. Further, each of the brackets include an outwardly extending leg portion 27 having sufficient length to engage and support the bottom portion 30 thereon. As stated above, the display means 12 may be removably mounted on the upper end 14' of the standard 14. Its disposition along the length of the standard 14 and its height above supporting ground surface 22 is dependent upon the particular location of the mounting support structure 24 and its spaced distance from the extremity 15 of the standard 14.

In order to prevent inadvertent removal of the display means 12 from the standard such as being passed over the upper extremity 15 thereof, the mounting means further comprises a locking structure as best shown in FIGS. 2 and 3. In a preferred embodiment, such locking structure includes a locking pin 48 having an elongated configuration and removably secured to pass through a channel 48' formed adjacent the upper extremity 15 of the standard 14. The length of the locking pin 48 is such as to be disposed in interruptive relation to the top portion 39 and more particularly positioned so as to restrict movement of the display means 12 and the top portion 39 from the upper extremity 15 of the standard 14. Obviously, removal of the locking pin 48 from the channel 48' and the standard 14 will allow removal of the display means 12 by sliding the display means off the upper extremity 15.

The relative dimensions of the subject sign assembly are such that, in a preferred embodiment, and based on local ordinances as well as for purposes of protecting the display means 12, it is located at least a predetermined minimum distance above the supporting ground surface 22. Such minimum distance is best found to be substantially 7½ feet wherein such distance extends from the ground surface 22 to the bottom portion 30 of the display means 12. Similarly, in a preferred embodiment each of the display faces has a height, between the bottom and top portions 39 and 30 respectively of 30 inches and a width of 24 inches. Therefore, the height of the display means in addition to the height of the standard extending from the ground surface 22 to the bottom portion 30 generally requires a length of the anchoring sleeve 18 being burried or embedded within the supporting ground surface 22 some 2½ to 3 times greater than the 7½ foot distance of the standard 14 extending between the supporting ground surface 22 and the bottom portion 30. This distance or the length of the anchoring means and lower end of standard 14 covered thereby is preferably in the range of 2½ to 3 feet. Again, the length of the anchoring means and the distance that the lower end of the standard 14 is disposed beneath the ground surface 22 is also dependent upon the soil conditions of the supporting ground as well as the weight, height, and overall configuration of the standard and display means 12.

Yet another structural feature of the present invention comprises both the peripheral boundaries of the aligned aperture means 26 and 41 having a configuration which substantially conforms to the exterior surface configuration of the standard 14. In the embodiment shown both the configuration of the aperture means 26 and 41 and the standard 14 are square and accordingly, the display means 12 is not allowed to rotate. While the aforementioned configurations are not intended to be limited to a square configuration, such configurations should be correspondingly structured so as to prevent such inadvertent rotation of the display means and thereby maintain the respective display faces in their preset positions.

What is claimed is:

1. A sign assembly of the type primarily designed to present pictorial representations and print media thereon, said assembly comprising:

(a) a standard having an elongated configuration and a multi sided outer surface configuration extending along the length thereof, said standard connected in supporting relation to a display means for display of information thereon, said display means removably mounted on an upper end of said standard in spaced relation above a supporting ground surface, (b) said display means comprising a plurality of display faces disposed in substantially adjacent relation to one another and in substantially parallel relation to the longitudinal axis of said standard, (c) said plurality of display faces collectively oriented to define a closed and substantially continuous, lateral peripheral surface of said display means disposed in surrounding relation to a hollow interior portion of said display means, (d) said display means further comprising a bottom portion and a top portion disposed in spaced relation to one another and each being secured to said plurality of display faces at opposite ends thereof and being further disposed and dimensioned to substantially close said hollow interior portion, (e) said bottom portion and said top portion each including linearly aligned aperture means formed therein for receiving said standard therethrough, said standard slidably received through each of said aperture means and through said hollow interior portion of said display means in coaxial relation thereto, each of said aperture means comprising a multi-sided peripheral configuration corresponding to said multi-sided configuration of said standard and disposed in registered engagement therewith and thereby preventing relative rotation between said display means and said standard while allowing sliding movement therebetween, (f) mounting means for removably securing said display means to said standard and comprising a mounting platform fixedly secured to said standard a spaced distance, substantially equal to a height of said display means, from an upper extremity of said standard exteriorly of said hollow interior portion and said bottom portion, said mounting platform including a planar seat extending radially outward from said standard and in substantially perpendicular relation to the length thereof, said planar seat disposed in surrounding relation to said standard and in abutting, removably supporting engagement with an outer surface of said bottom portion.

(g) said planar seat comprising a plurality of mounting brackets equal in number to the number of sides of said multi-sided configuration of said standard, each mounting bracket secured to a separate side of said standard and extending outwardly therefrom, each of said brackets including a first leg portion fixedly secured to said respective separate sides and a support portion extending outwardly from said first leg portion in perpendicular relation thereto and to said respective separate sides, said support portion of each mounting bracket oriented in coplanar relation to one another and collectively defining said planar seat being disposed to substantially surround said standard, (h) said mounting means further comprising a locking structure disposed adjacent said upper extremity of said standard and said top portion and removably secured to said standard and dimensioned to extend outwardly therefrom into blocking, interruptive relation to said top portion when said locking structure is mounted on said standard, (i) said display means maintained in removably supported engagement with said standard and on said mounting platform between said planar seat and said locking structure and slidably removable from said standard and off of said upper extremity thereof upon removal of said locking structure, and (j) base means secured in substantially enclosing relation about a lower end of said standard a predetermined minimum distance from said display means and disposed in penetrating relation to the supporting ground surface.

2. An assembly as in claim 1 wherein said display means further comprises a display panel formed of a flexible material and structured to define said plurality of display faces formed thereon, each of said display faces separated from a next adjacent display face by a fold line positioned on said display panel in a position common to correspondingly positioned peripheral edges of both said adjacent display panels.

3. An assembly as in claim 2 wherein each of said display faces are bendable about respective ones of said fold lines into substantially transverse relation to a next adjacent display face, whereby each of said display faces are oriented to face outwardly from said display means in a direction different from the other of said display faces.

4. An assembly as in claim 3 wherein said plurality of display faces correspondingly define a continuous, multiplanar lateral surface of said display means and each of said display faces comprising a plurality of display zones.

5. An assembly as in claim 4 wherein said plurality of display zones include a first zone having an exposed surface area dimensioned and configured to include print media thereon and a second zone having an exposed surface area dimensioned and configured to include pictorial media thereon, whereby said display faces are each dimensioned and structured to concurrently display multi-pictorial and print media representation.

6. An assembly as in claim 5 wherein said first zone is disposed to extend along the length of a lower peripheral edge of each of said display faces and said exposed surface thereof adapted to display printed media representative of street names thereon; said second zone disposed above said first zone and extending therefrom to an upper peripheral edge of each display face, said exposed surface of said second zone being substantially greater and adapted to display a pictorial advertising representation thereon.

7. An assembly as in claim 1 wherein said base means comprises an anchoring sleeve formed from cementitious material and extending in surrounding, substantially encasing and bonded relation about the lower end of said standard, said anchoring sleeve extending continuously along a minimum predetermined length of said standard from a lower extremity thereof upwardly towards an opposite end of said standard.

8. An assembly as in claim 7 wherein said anchoring sleeve comprises at least a major portion of its length disposed in burried position below a supporting ground surface.

9. An assembly as in claim 8 wherein the length of said standard extending from a supporting ground surface to said display means is substantially 2.5 to 3 times greater than the length of said anchoring sleeve extending below the supporting ground surface.

10. An assembly as in claim 9 wherein said display means extends upwardly from a lower disposed portion of said mounting means substantially 2.5 feet and is spaced from the supporting ground surface substantially 3 times the latter dimension.

* * * * *